US006112918A

United States Patent [19]

Burgess

[11] Patent Number: 6,112,918

[45] Date of Patent: Sep. 5, 2000

[54] PRODUCT SHELVING CONSTRUCTION

[75] Inventor: Thomas E. Burgess, Geneva, Ill.

[73] Assignee: Thomas Burgess, Geneva, Ill.

[21] Appl. No.: 09/183,313

[22] Filed: Oct. 30, 1998

[51] Int. Cl.[7] ..... A47B 43/00

[52] U.S. Cl. ..... 211/186; 211/150; 108/101

[58] Field of Search ..... 211/186, 198, 211/181.1, 150, 200, 85.26; 108/188, 101; 297/158.1

[56] References Cited

U.S. PATENT DOCUMENTS

| | | | |
|---|---|---|---|
| D. 79,497 | 11/1929 | Buchwalter | D6/429 |
| 364,547 | 6/1887 | Rose | 211/85.26 |
| 426,697 | 4/1890 | Webb | 211/198 X |
| 471,697 | 3/1892 | Mosbacher | 108/188 |
| 538,145 | 4/1895 | Allen | 211/149 X |
| 1,106,418 | 8/1914 | Sprunger | 211/198 X |
| 1,823,396 | 9/1931 | Goulet | 108/101 X |
| 1,929,768 | 11/1933 | Bixby | 211/149 X |
| 2,047,097 | 7/1936 | Dunbar | 211/150 X |
| 2,648,442 | 8/1953 | Lowmaster | 108/101 X |
| 2,716,495 | 8/1955 | Prevette et al. | 211/149 X |
| 3,200,961 | 8/1965 | Kolster et al. | 211/186 |
| 3,549,019 | 12/1970 | Wood | 211/135 |
| 3,677,203 | 7/1972 | Barrineau | 108/111 |
| 3,894,634 | 7/1975 | Gotham et al. | 211/150 |
| 4,122,781 | 10/1978 | Potter | 108/92 X |
| 4,462,500 | 7/1984 | Konstant et al. | 211/162 X |
| 5,221,014 | 6/1993 | Welch et al. | 211/187 |
| 5,553,551 | 9/1996 | Crombie | 108/181 |
| 5,590,796 | 1/1997 | Herman | 211/149 |

*Primary Examiner*—Daniel P. Stodola
*Assistant Examiner*—Khoa Tran
*Attorney, Agent, or Firm*—Banner & Witcoff, Ltd.

[57] ABSTRACT

A display stand includes first and second vertical support members with inclined forwardly projecting side support members. The support members are interconnected by means of forwardly extending cross bars or brackets which define inclined or horizontal shelves. Connecting members between the cross bars provide the shelving for the display stand. The stand may be fabricated from linear members maintained as a display stand kit.

6 Claims, 2 Drawing Sheets

PRODUCT SHELVING CONSTRUCTION

BACKGROUND OF THE INVENTION

This invention relates to display shelving and, more particularly, to a kit which may be assembled to provide display shelving such as display shelving for nursery and agricultural products. Shelving products, particularly shelving products made of metal, are often used to display products in stores or nurseries for example. Typically metal shelving systems are fabricated from rods or bracket members which provide horizontal shelves onto which displayed product is positioned. For example, in U.S. Pat. No. 5,221,014, there is disclosed modular shelving fabricated from rods which are formed to define upright support members and horizontal shelves. The shelves are generally supported between upright members which define comer posts. The shelves are typically horizontal.

While such shelving is extremely useful for storing and displaying products, it does not provide a means for easily and completely displaying product in a retail environment. That is, product stored in the middle of the shelf is not easily accessible or cannot be easily viewed by a consumer. Thus there has developed a need for an improved shelf display system which may be easily assembled at a retail site and which may also be easily adjusted to enhance the product display.

SUMMARY OF THE INVENTION

In a principal aspect, the invention constitutes a display stand which is comprised of pairs of vertical rear support members and forwardly extending inclined support members attached to the rear support members. Crossing brackets connect the rear support members. Cross members connect the rear and inclined support members and extend outwardly in a horizontal direction or inclined downwardly from the framework defined by the rear and inclined support members. The cross members are interconnected by connecting members which define the shelving for product display. The shelving may include a forward flange for retaining items on the display support shelf. The cross members and support members include multiple attachment points to permit adjustment of the shelving between a horizontal display position and an inclined display position.

Optional features such as a horizontal cross bar may be provided to interconnect the vertical rear support members. The bar may then be used to display further product. The entire assembly may be provided in a kit form so that it may be easily assembled and disassembled. The component parts may be made from wood or metal or mixed wood and metal components and the shelving may be an expanded metal mesh.

Modular assemblies of display stands may be arranged side-by-side or back-to-back array or in combinations to facilitate display of product on the display stands. The display stands are especially useful for the display and merchandising of plants and agricultural products, but are useful with the display and merchandising of almost any product.

Thus, it is an object of the invention to provide an improved display stand which has the capability of being provided in a kit form.

A further object of the invention is to provide a display stand which is easy to assemble yet rugged and capable of supporting a significant weight of product.

Yet another object of the invention is to provide a display stand wherein cantilever shelves are provided for displaying product. The cantilever shelves may be arranged to define horizontal or inclined shelving.

Another object of the invention is to provide an improved display stand which is economical to manufacture, easy to assemble, rugged and safe.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
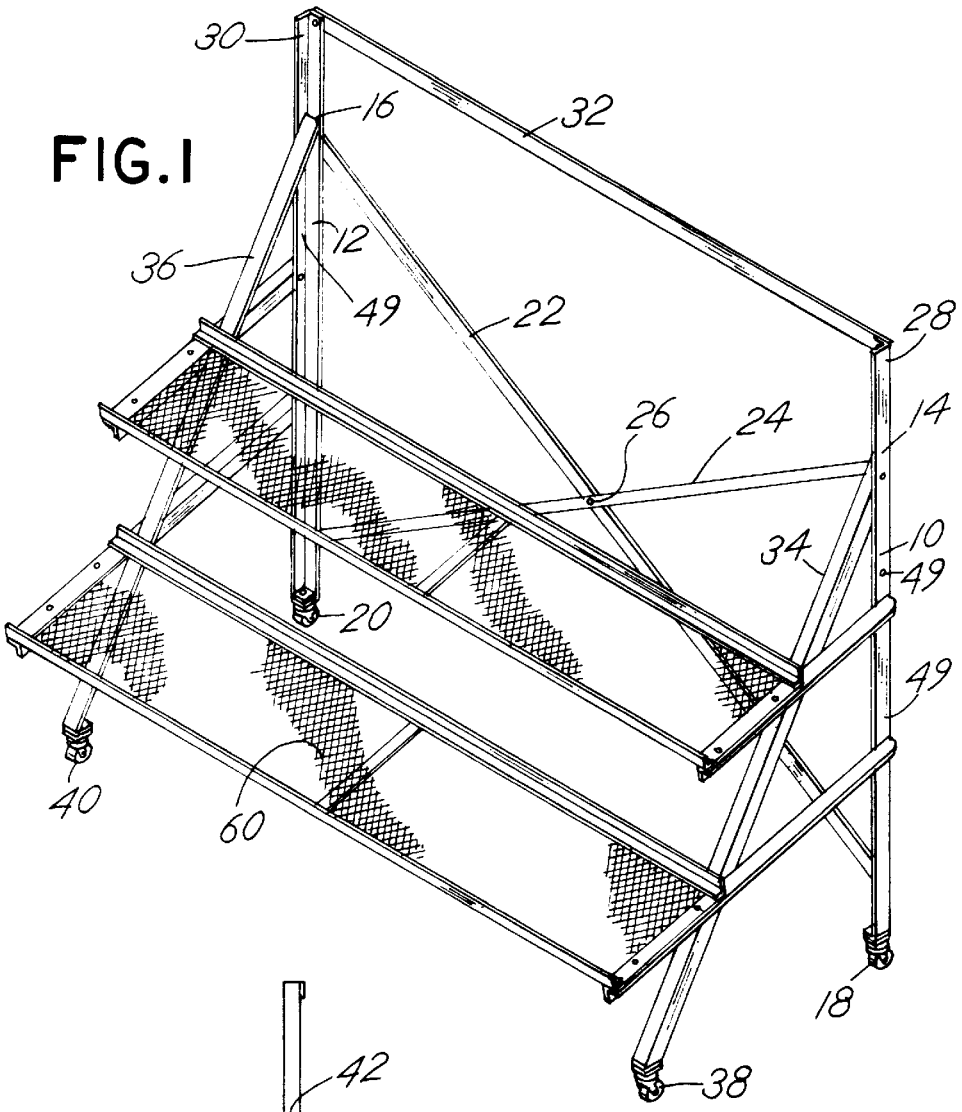
FIG. 1 is an isometric view of an embodiment of the invention wherein first and second display shelves are provided.

Referring to the figures, and in particular FIG. 1, the display stand of the invention comprises a first rear support member 10, a second rear support member 12. The support members 10 and 12 are of substantially equal length may include a top end 14 and 16 respectively. The support members 10 and 12 are vertically upstanding members and rest upon the floor. Optional casters such as casters 18 and 20 may be provided. The casters 18 and 20, of course, preferably include caster wheel locks which may be released so that the casters 18, 20 and thus the display stand may be moved. In any event, the rear members 10 and 12 project vertically upwardly and are spaced apart. Cross braces 22 and 24 connect the members 10 and 12. The cross braces preferably include a fastener 26 at their mid or cross-over point. The rear support members 10 and 12 further include an upper end extension 28 and 30, respectively. Cross bar 32 connects with the upper ends 28 and 30. The bar 32 is devised to support and receive hanging products, for example, hanging plants or the like.

Projecting outwardly and downwardly from the rear support members are inclined third and fourth support members 34 and 36, respectively. The third support member 34 connects from the top end 14 or near the top end 14 and extends downwardly and outwardly from a connection point to the first rear support member 10. An optional caster 38 is provided at its lower end. The fourth inclined support member 36 also projects outwardly and downwardly from the second rear support member 12. The fourth inclined support member 36 also includes an optional caster 40. The inclined support members 34 and 36 are generally parallel and equally spaced from one another and, in combination with rear support members 10 and 12, define parallel A-frame constructions. The support members 34 and 36 are attached respectively to the rear support members 10 and 12 by means of a bolt, for example bolt 42. Other types of fasteners may also be used. The support members, such as members 10, 12, 34 and 36 may be provided in a kit along with braces, for example, braces 22 and 24, and may be provided, along with the other components described in unassembled condition for assembly at a display stand site.

Thus the fasteners such as fasteners 26 and 42 may be attached to the assembly during assembly thereof.

A first cross member 44 and a second cross member 46 are provided for use in combination with each of the A-frames defined by rear support member 10 and inclined support 34 and rear support member 12 and inclined support 36, respectively. The cross members 44 and 46 are attached to the rear members 10 by means of a fastener 48 and to the inclined member 34 by a fastener 50. The cross members 44,46 extend outwardly and associated with each of the described A-frames thus define cantilever planes.

Figure 2:
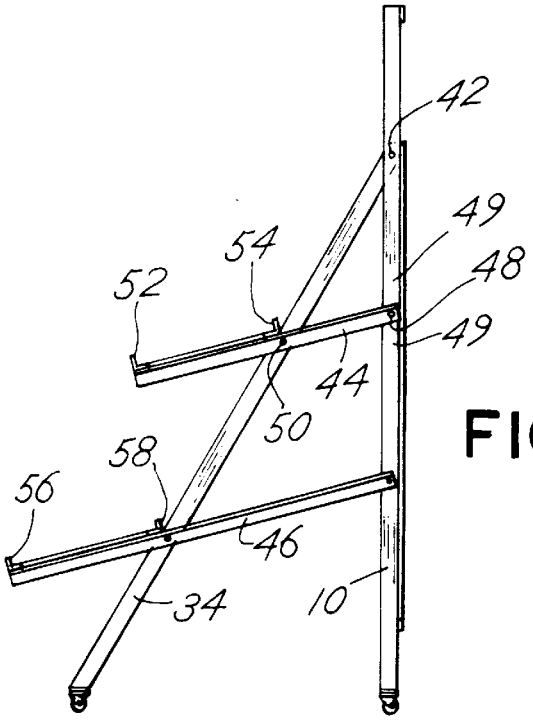
FIG. 2 is a side elevation of the display shelf of FIG. 1.
Figure 3:
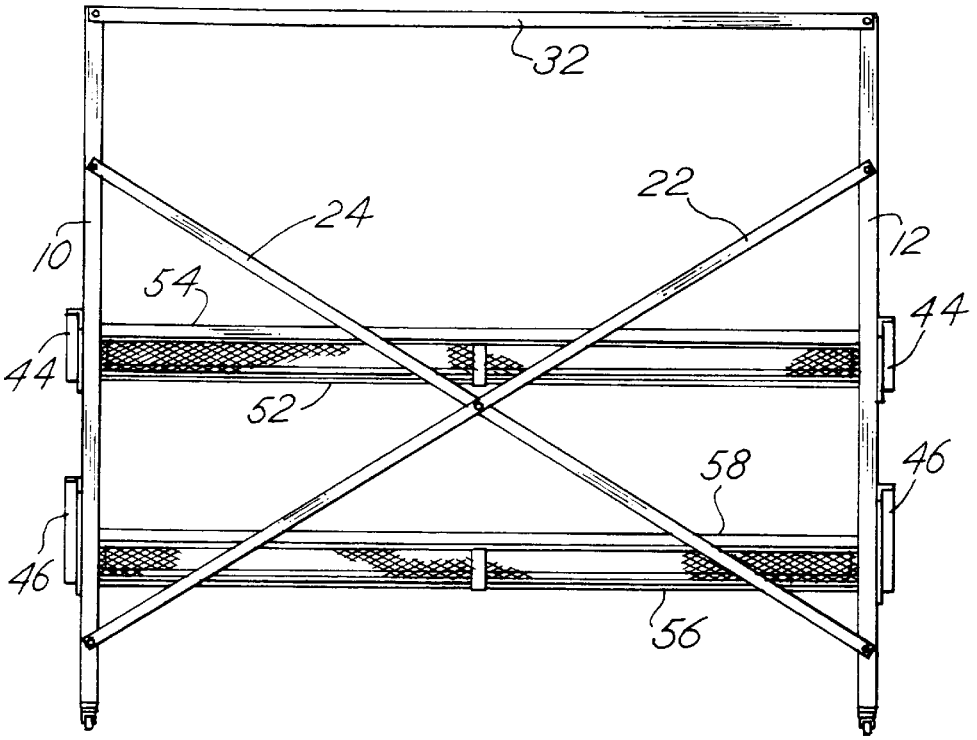
FIG. 3 is a back plan view of the display shelf of FIG. 1.

Connecting members, such as connecting members 52 and 54, connect the cross members 44. Connecting members 56 and 58 connect cross members 46. The forward connecting members, such as members 52 or 56, define a flange which supports product on the shelf defined by the connecting members 52, 54, 56, 58 and associated cross members 44, 46. An extra element such as a strip of metal or wood may also be attached to members 52 and/or 56 to serve as a support flange. In a preferred embodiment, an expanded wire metal mesh 60 is welded or otherwise attached to the cross members 44, 46 and connecting members 52, 54, 56, 58. In this manner, a cantilever shelf extends outwardly. The angle of inclination of the cross members 44 and 46 may be adjusted by appropriate connection of the fastener 48 through appropriate openings 49 in the rear support member 10 and support member 34 or rear support 12 and support member 36. Fastener 50 serves as a pivot connection. Thus, as depicted in FIG. 4, adjustment may be made by tilting the cantilever shelf defined by the cross members 44 or 46 between a horizontal position as illustrated in FIG. 4 to an inclined position as illustrated in FIG. 2.

The adjustment of the cross members 44 and 46 is affected by means of inserting fasteners through openings 49 in the rear support members 10, 12 and the cross members 44 and/or 46 as well as the inclined support members 34, 36. It can be appreciated by examination of FIGS. 2 and 4 that the vertical rear members 10 and 12 define a planar back side of the display shelf. The inclined members 34, 36 provide rigidity along the sides of the display stand. The connecting members such as members 52, 54, 56 and 58 provide lateral rigidity. The braces 22 and 24 provide further integrity to the structure.

Figure 4:
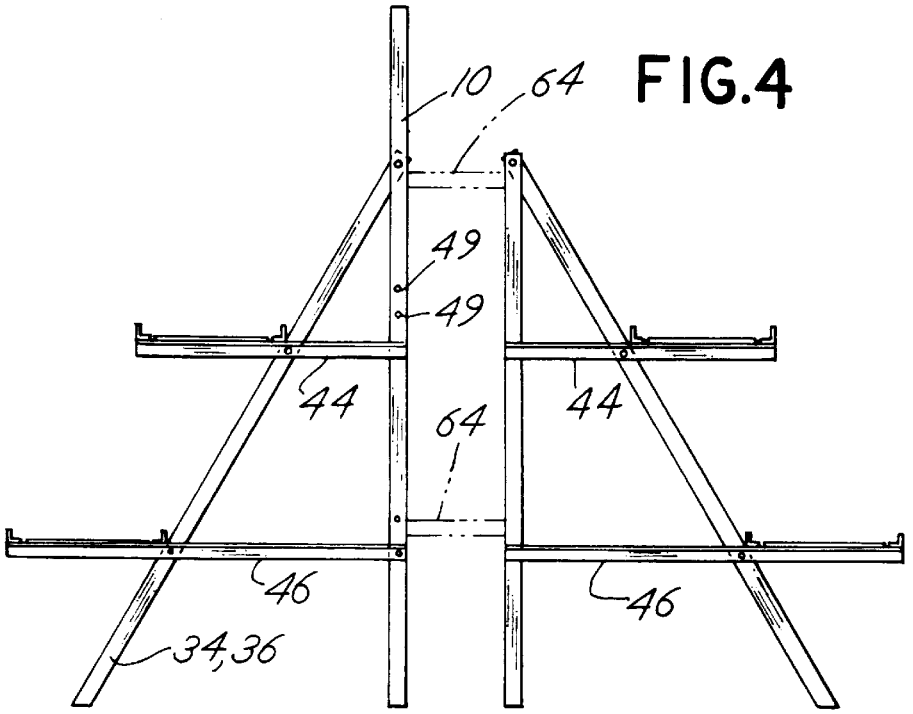
FIG. 4 is a side elevation of a display stand of the type shown in FIG. 1 wherein the shelves have been configured to be in a horizontal orientation and further wherein an adjacent display stand is positioned in back-to-back relation therewith.

As also illustrated in FIG. 4, display stands may be arranged back-to-back and connected to one another either by a further connecting bar or bracket such as bar or bracket 64 or they may be directly connected to one another by bolts for example. In a preferred embodiment, all of the members described are fabricated from metal such as steel or aluminum precut to the desired length and which further include pre-drilled openings therethrough for receipt of fasteners such as nuts and bolts. The angle of adjustment of the shelves defined by the cross members 44 and 46 is preferably in the range of about 0° to about 20° or 25° from horizontal. The connecting members 52, 54 are preferably of steel, however, wood shelves may be provided. The wood shelves serve to provide rigidity as well as product support. The units can be fabricated in modular lengths typically up to eight feet. The casters may be provided optionally to provide for easy movement and location of the display stand. The upper cross bar 32 may be provided for hanging products for further display.

Although the embodiment depicted utilizes two parallel cantilever shelves, a single shelf may be provided or more than two shelves may be provided. Also, the shelves need not be arranged in a parallel fashion. They may be angled at different degrees. For example, the upper shelf may be horizontal and the lower shelf may be canted or arranged at an angle of 20° by way of example. If the upper shelf is removed, then the lower shelf can be utilized for display of larger items.

Thus, while there has been described a preferred embodiment of the invention, it is to be understood that the invention is to be limited only by the following claims and equivalents thereof.

What is claimed is:

1. A display stand comprising, in combination:

first and second substantially vertical, generally parallel rear support members, each rear support member having a top end and a bottom end;

third and fourth inclined support members each having a top end connected respectively at first and second connections to the first and second rear support members and extending from the top end of said third and forth inclined support members, to define first and second generally parallel A-frames with the third and fourth support members substantially parallel, said first and second rear support members including upward extensions from said first and second connections;

at least two cross members connecting each of the first and third and second and fourth members, said cross members being pivotally connected at an intermediate point to the third and fourth members and at one end to the first and second members, with the opposite ends thereof extending outwardly from the third and fourth members to define a cantilever plane;

at least two connecting members connecting the cross members to define a cantilever support shelf in the cantilever plane; and reinforcing members connecting the first and second rear support members, said reinforcing members including a generally horizontal cross bar connecting the outer end of the upward extension of the rear support members and further including cross braces connecting the rear support members at a location intermediate the first and second connection points and the bottom of the rear support members, said rear support members and said cross members including at least two separate attachment points to allow adjustment of the angle of inclination of the cantilever plane shelf.

2. The display stand of claim 1 wherein the members are fabricated from metal and further including an expanded metal screen in the cantilever plane defining the support shelf.

3. The display stand of claim 1 wherein at least one connecting member includes an upturned flange for retaining items on the support shelf.

4. The display stand of claim 1 including at least one set of attachment points defined in the support members for engaging with fasteners to attach the shelf cross members and for maintaining the support shelf substantially horizontal and a second set of attachment points defined in the support members for maintaining the support shelf inclined downwardly from its connection to the rear support members whereby articles on the shelf may be displayed.

5. The display stand of claim 1 including a second display stand of substantially identical construction having first and second rear support members in opposed relation to the second and first rear support members of the display stand and further including brackets attaching the first and second rear support members of to display stand to the second and first rear support members of the second display stand.

6. A display stand in the form of a kit of separate members, each member comprising a straight member attachable to other members to form the display stand and further including removable fasteners said display stand kit including:

first and second substantially vertical, generally parallel rear support members, each rear support member having a top end and a bottom end;

third and fourth inclined support members each having a top end connected respectively at first and second connections to the first and second rear support members and extending from the top end of said third and fourth inclined support members, to define first and second generally parallel A-frames with the third and fourth support members substantially parallel, said first and second rear support members including upward extensions from said first and second connections;

at least two cross members connecting each of the first and third and second and fourth members, said cross members being pivotally connected at an intermediate point to the third and fourth members and at one end to the first and second members, with the opposite ends thereof extending outwardly from the third and fourth members to define a cantilever plane;

at least two connecting members connecting the cross members to define a cantilever support shelf in the cantilever plane; and reinforcing members connecting the first and second rear support members, said reinforcing members including a generally horizontal cross bar connecting the outer end of the upward extension of the rear support members and further including cross braces connecting the rear support members at a location intermediate the first and second connection points and the bottom of the rear support members, said rear support members and said cross members including at least two separate attachment points to allow adjustment of the angle of inclination of the cantilever plane shelf.

* * * * *